US005158260A

United States Patent [19]

LeBlanc et al.

[11] Patent Number: 5,158,260

[45] Date of Patent: Oct. 27, 1992

[54] VAPOR VENT VALVE

[75] Inventors: Leo J. LeBlanc, Bloomfield Hills; Bruce R. Johnson, Muskegon, both of Mich.

[73] Assignee: EBW, Inc., Muskegon, Mich.

[21] Appl. No.: 745,016

[22] Filed: Aug. 14, 1991

Related U.S. Application Data

[63] Continuation-in-part of Ser. No. 727,076, Jul. 9, 1991, Pat. No. 5,072,912.

[51] Int. Cl.[5] ..... F16K 31/122

[52] U.S. Cl. ..... 251/63.4; 251/63.5; 251/144

[58] Field of Search ..... 251/63.4, 63.5, 144

[56] References Cited

U.S. PATENT DOCUMENTS

| | | | |
|---|---|---|---|
| 4,285,495 | 8/1981 | King | 251/63.5 |
| 4,479,507 | 10/1984 | Nichols | 137/219 X |
| 4,721,283 | 1/1988 | Wilson | 251/63.4 |

*Primary Examiner*—Gerald A. Michalsky
*Attorney, Agent, or Firm*—Basile and Hanlon

[57] ABSTRACT

A vent valve for controlling the flow of vapor to or from the head space of a storage tank for fuel or other liquids includes a valve housing scalingly mounted in an opening through the top of the tank. A vertical vapor flow passage through the housing opens at its upper end at the exterior of the tank and at its lower end into the headspace of the tank. A spring biased valve head normally closes the lower end of the vapor flow passage to seal the headspace of the tank. A detachable and disposable pneumatic motor is mounted in a downwardly convergent frusto conical seat defined within the flow passage by webs integrally formed on the housing. The motor has a motor cylinder whose exterior surface is of a frusto conical configuration complementary to the seat and is wedged downwardly into the seat by mounting screws which pass through tabs formed on the cylinder into threaded bores in the top surfaces of the webs accessible from the upper end of the passage. The wedge action provides a seal between an air flow passage through the cylinder wall and an air flow passage through one of the webs through which air under pressure may be passed to drive the motor piston and its rod downwardly against the valve head to open the valve. The motor, including the piston and rod may be molded from a suitable thermoplastic material.

14 Claims, 2 Drawing Sheets

VAPOR VENT VALVE

REFERENCE TO RELATED APPLICATION

This application is a continuation-in-part of a commonly-owned co-pending application Ser. No. 07/727,076, filed Jul. 9, 1991, now U.S. Pat. No. 5,072,912.

BACKGROUND OF THE INVENTION

The present invention is directed to a vapor vent valve especially adapted for use on gasoline tank trucks to accommodate the flow of fuel vapor to or from the headspace of the tank during a fuel loading or unloading operation. The present invention is directed to improvements to the vapor vent valve which is the subject of the above-identified parent application.

When gasoline is transferred from a storage tank at the supply terminal into the delivery truck tank, and again when the gasoline is transferred from the delivery truck tank to the underground storage tank at a service station, fuel vapor must be expelled from the headspace of the tank receiving the fuel. Present-day environmental standards prohibit the discharge of this expelled fuel vapor into the atmosphere, and the standard present-day practice is to connect the headspaces of the delivering tank and the receiving tank to each other so that fuel vapor expelled from the receiving tank by the incoming fuel is conducted into the headspace of the delivering tank to maintain a constant headspace pressure in the delivering tank. At the conclusion of the fuel transfer operation, the headspace of each of the two tanks is sealed.

A vent valve for a delivery truck tank will most logically take the form of a normally closed valve, held closed by a spring. Compressed air for operating the truck brakes is readily available, and the utilization of a pneumatic motor for opening the vent valve is quite conventional. The pressure differential across the valve, when closed, is normally quite small, hence the biasing spring need only be strong enough to hold the valve closed in the face of bumps and shock loading encountered during movement of the truck. In a valve of this type. the weakest point of the system is the piston seal of the pneumatic motor. Leakage past the valve head—valve seat seal, while undesirable, is not a large problem in that the pressure differential across the seal is so small that the amount of vapor leakage is minimal. Leakage or failure of the piston seal, on the other hand, can prevent actuation of the valve. In that the motor is actuated only infrequently and a high degree of precision is not required, the tendency is to fabricate the motor as cheaply as possible.

These vent valves are mounted in an opening in the top of the tank, the valve housing being effectively a short, reasonably large diameter pipe section extending vertically through the top wall of the tank with its lower end opening into the interior of the tank and its upper end opening at the exterior of the tank. The valve head can consist simply of a circular plate located at the lower end of the valve housing and biased upwardly by springs to seat against and close the lower end of the passage through the valve housing. The pneumatic motor is almost invariably mounted within the passage through the housing with its piston rod extending downwardly and connected to the vent valve head. The open upper end of the valve housing is sealed by a detachable hood coupled to a vapor conducting conduit through which fuel vapor flows to or from the upper end of the valve passage. With this arrangement, access to the valve interior is through the open upper end of the valve housing which in turn is accessible on removal of the hood referred to above.

With many of the prior art valves, it is not possible to service the valve, as by replacing a piston seal, for example, without removing the entire valve assembly from the tank truck. The present invention is directed to an arrangement in which a disposable valve actuating motor may be readily removed as a unit from the valve while the valve housing remains in place on the truck tank.

SUMMARY OF THE INVENTION

A vent valve according to the present invention includes a hollow, generally cylindrical housing having an outwardly projecting mounting flange for mounting the housing to project through an opening in the top of a storage tank in sealed relationship to the tank wall. When mounted on the tank, the lower end of the passage through the housing is located within the interior of the tank, but is normally sealed from communication with the tank interior by a valve head spring biased upwardly into engagement with an annular valve seat extending around the periphery of the passage at its lower end.

Above the valve seat, two (or more) vertical webs are integrally formed with the housing and project radially inwardly of the passage to opposed inner edges which are spaced from each other. The inner edges of webs are downwardly convergent to cooperatively define a seat for receiving a downwardly convergent frusto conical "cylinder" of a pneumatic motor having a piston rod projecting downwardly from the cylinder to rest upon the top surface of the valve head. The piston rod is fixedly coupled to a piston received within a piston chamber in the cylinder, the piston rod being movable along the central vertical axis of the passage through the housing. Mounting tabs integrally formed on the motor cylinder project radially outwardly into overlying engagement with the webs, and screws passing through bores in the webs are threadably received in tab bores extending downwardly into the webs. A passage for conducting air under pressure to and from the chamber above the piston passes through one of the webs, and one of the screws holding the motor in place on the webs is located at a greater distance from the axis of the motor than is the other screw to assure that the port in the motor for conducting air to and from the piston chamber is mated with that web having the air passage extending through it.

With the arrangement described above, the entire motor as a unit is easily accessible from that end of the passage opening at the exterior of the storage tank. The motor housing, piston and piston rod may be easily molded from a suitable thermoplastic material at a manufacturing cost low enough to be a disposable unit.

Other objects and features of the invention will become apparent by reference to the following specification and to the drawings.

IN THE DRAWINGS

DETAILED DESCRIPTION OF THE PREFERRED EMBODIMENT

Figure 1:
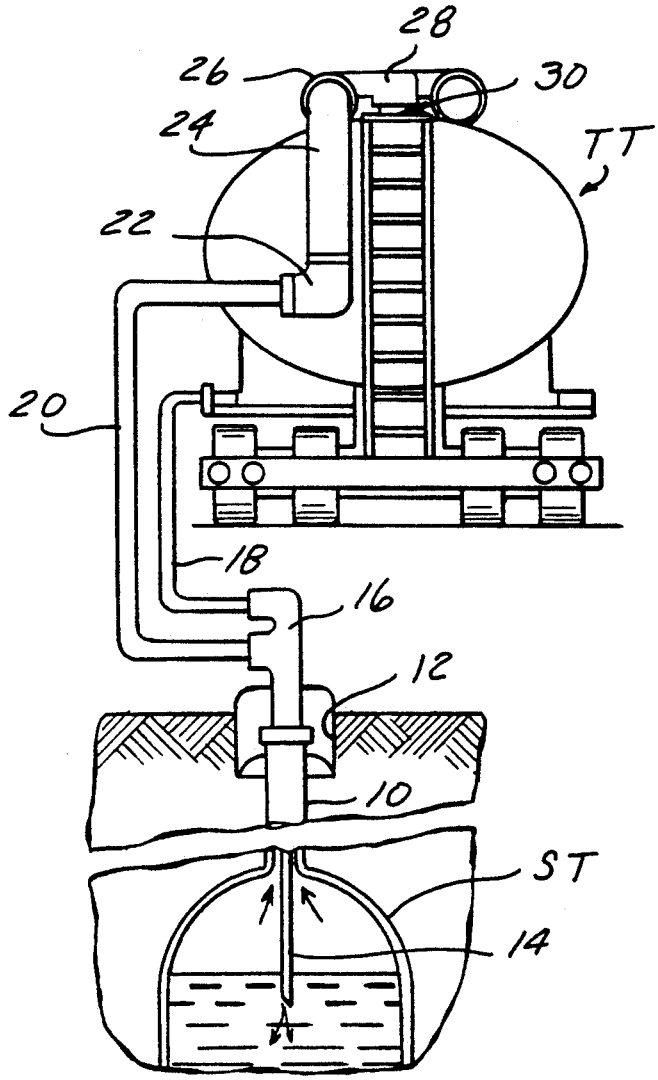
FIG. 1 is a schematic diagram, partially in cross-section of a tanker truck in the process of filling an underground storage tank and utilizing a vent valve embodying the present invention.
Figure 3:
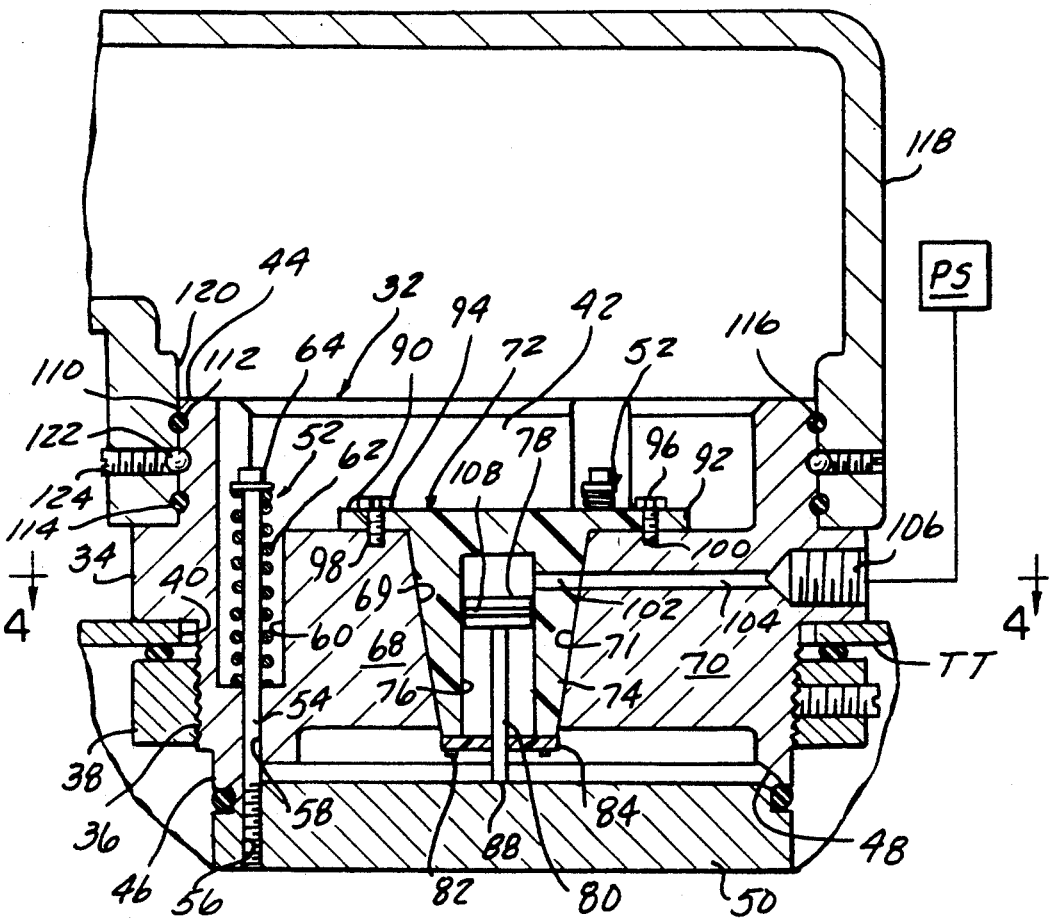
FIG. 3 is a detailed cross-sectional view of the valve of FIG. 2 taken on line 3—3 of FIG. 2.
Figure 2:
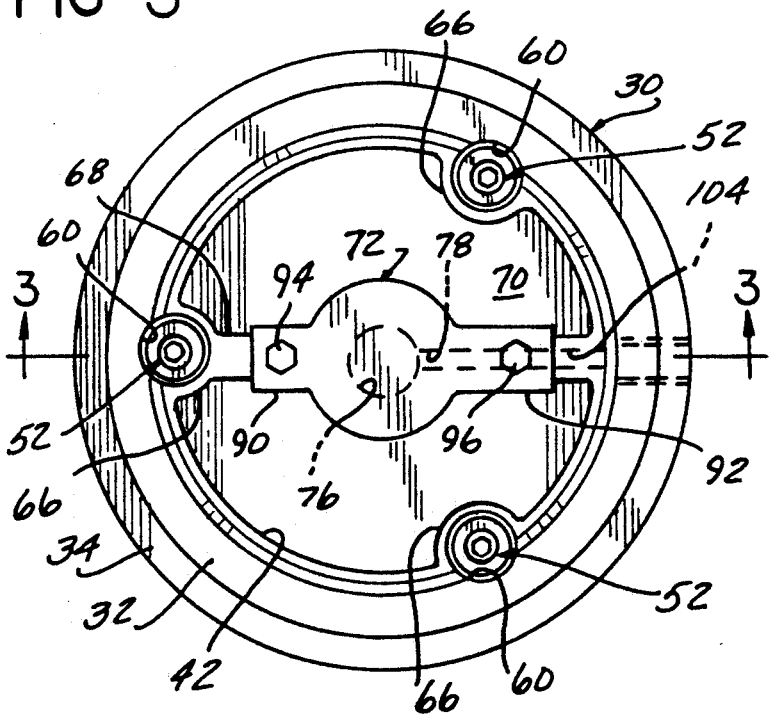
FIG. 2 is a top plan view of a vent valve embodying the present invention.

A typical application of a vent valve according to the present invention is schematically illustrated in FIG. 1 in the filling of an underground storage tank ST with gasoline from a tank truck TT. A relatively large diameter fill pipe 10 extends upwardly from the top of the underground tank ST into a relatively shallow manhole 12. Coaxially disposed within fill pipe 10 is a smaller diameter drop tube 14. A so-called coaxial coupling elbow 16 of known construction coupled to the upper ends of fill pipe 10 and drop tube 14 conducts gasoline flowing through the tank truck delivery hose 18 into drop tube 14, while fuel vapor from the headspace of the underground tank ST flows upwardly as indicated by the arrows in FIG. 1 through the passage between the interior of fill pipe 10 and the exterior of drop tube 14 through coupling 16 into a vapor recovery hose 20. Hose 20 conducts vapor from the headspace of tank ST through a coupling 22 and pipe 24 to the hollow overturn rail or pipe 26 at the top of the truck tank TT. A hood 28 conducts vapor from pipe 26 to a valve 30 embodying the present invention which, when open, allows fuel vapor to pass from hood 28 into the headspace of the truck tank TT. With valve 30 open, what is illustrated in FIG. 1 is essentially a closed loop system in which gasoline which flows from the tank TT into the underground storage tank ST displaces fuel vapor from the headspace of tank ST which is in turn conducted to the headspace of the tank TT from which the gasoline is being dispensed. Thus, the headspace pressure in the two tanks remains constant and equal throughout the fuel transfer operation. Details of the vent valve according to the present invention are best seen in FIGS. 2 and 3.

The vent valve 30 of the present invention is, with the exception of the structure of the pneumatic valve actuating motor and the manner in which this motor is mounted within the valve housing, very similar to the vent valve disclosed in our parent application Ser. No. 07/727,076, now U.S. Pat. No. 5,072,912. In the valve disclosed in the parent application, the motor housing or cylinder of the pneumatic valve actuating motor is cast as an integral portion of the valve housing. In accordance with the present invention, the pneumatic valve actuating motor is constructed as a separable, and preferably disposable, subassembly which may be detachably assembled into a pocket or seat formed in the valve housing in a manner such that access to the motor for mounting or removal is possible from the exterior of a tank in which the valve is mounted. In the valve of parent application Ser. No. 07/727,076, now U.S. Pat. No. 5,072,912, removal of the piston of the pneumatic valve actuating motor from its piston chamber required the removal of the entire valve from its storage tank and disassembly of the valve head from the valve housing.

The exterior configuration of the valve housing 32 of the present invention is substantially the same as that of the valve of the parent case, the valve housing 32 being of a generally cylindrical hollow tubular configuration formed with a radially outwardly projecting annular mounting flange 34 approximately midway between the upper and lower ends of housing 32. Below mounting flange 34, a somewhat reduced diameter threaded section 36 (FIG. 3) is formed on the housing to threadably receive an annular clamping ring 38 employed to sealingly clamp the housing in position within an opening 40 in the top of tank TT as best seen in FIG. 3. As best seen in FIG. 2, a central passage 42 extends downwardly through housing 32 from the top 44 of housing 32 to its bottom 46. At the bottom end of the central passage 42, a downwardly divergent frusto conical valve seat 48 is formed around the periphery of passage 42. A circular plate-like valve head 50 is supported below the lower end of valve housing 32 by three spring assemblies designated generally 52.

Figure 4:
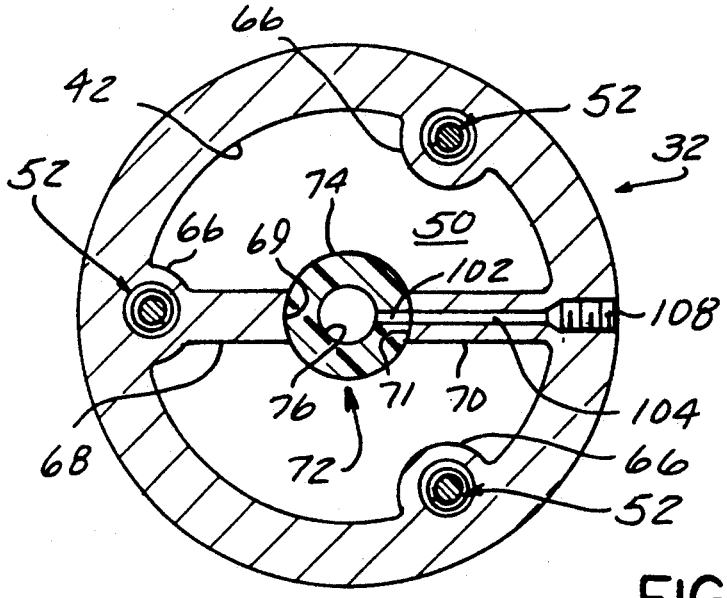
FIG. 4 is a detailed cross-sectional view taken on line 4—4 of FIG. 3.

Each spring assembly 52 (FIG. 3) includes a guide rod 54 threadably received at its lower end in a tapped bore 56 in valve head 50 and projecting upwardly through a guide bore 58 in housing 32. The upper end portion of each guide bore 58 is formed with an enlarged diameter counter-bore 60 which receives a compression spring 62 which is engaged beneath a washer or enlarged head portion 64 at the upper end of guide rod 54 to resiliently bias the guide rod and the attached valve head 50 upwardly as viewed in FIG. 3. As best seen in FIGS. 2 and 4, the spring assemblies 52 are symmetrically disposed about the axis of valve.

The guide bores 58 and counter-bores 60 are formed in inwardly projecting enlargements such as 66 on the wall of passage 42. Two vertically oriented webs 68 and 70 are integrally formed on housing 32 and project radially inwardly into passage 42 from diametrically opposed locations. Webs 68 and 70 terminate at their radially inner ends in downwardly and inwardly inclined side edges 69 and 71 respectively. The side edges 69 and 71 cooperatively define a seat for receiving and locating a pneumatic valve actuating motor designated generally 72.

Motor 72 includes a motor housing 74 having a blind bore 76 extending upwardly into housing 74 from its lower end to define a piston chamber. A piston 78 having an integrally formed piston rod 80 is slidably received within bore 76, with rod 80 projecting downwardly from piston 78 through a lower end cap 82 fixedly secured to the lower end of housing 74 as by screws 84. Piston rod 80 is loosely slidably received within a bore 86 in end cap 82 and the lower end 88 of piston rod 80 rests upon, but is not fixedly attached to, the upper surface of valve head 50.

The outer side surface of motor housing 74 is formed with a downwardly convergent frusto conical configuration which matches the inclination of the side edges 69 and 71 of webs 68 and 70, the edges 69 and 71 being of a concavely curved configuration (FIG. 4) complementary to the side surface of housing 74. Mounting tabs 90 and 92 project radially outwardly from the upper end of housing 74 to rest upon the upper surfaces of webs 68 and 70, screws 94, 96 passing through bores in the respective tabs 90, 92 to be threaded into tapped bores 98, 100 formed in webs 68 and 70 respectively. When screws 94 and 96 are tightened downwardly, the inclined outer surface of motor housing 74 is firmly wedged into the motor seat defined by the convergently inclined side edges 69 and 71 of the webs. This tightly wedged engagement provides a fluid tight seal around the juncture of a porting passage 102 in motor housing 74 and a mating passage 104 which extends from an externally accessible port 106 in mounting flange 34 to open through edge 71 of web 70. To assure that the motor is mounted in the correct orientation between webs 68 and 70, one of the two screws 94, 96 is located at a greater radial distance from the motor axis than is the other screw.

Motor housing 74, the one piece piston and piston rod 78, 80 and lower end cap 82 are preferably formed in a molding operation utilizing a suitable thermoplastic material. An o-ring 108 mounted in a groove in the periphery of the piston 78 will provide a sufficient sliding seal between the opposite faces of the piston. The piston chamber below piston 78 need not be sealed in that the spring assemblies 52 which bias valve head 50 to the closed position also function as a return spring mechanism biasing the piston-piston rod 78, 80 to its uppermost position. To drive valve head 50 to its open position and place passage 42 in communication with the interior of tank TT, air under pressure is supplied from a suitable pressure source indicated schematically at PS in FIG. 3, to apply pressure against the upper face of piston 78 to drive the piston and piston rod downwardly to in turn drive valve head 50 downwardly against the bias of spring assemblies 52. Upon subsequent venting of this pressure from the upper side of piston 78, the spring assemblies 52 restore the valve head and piston to their respective elevated valve closed positions.

The exterior of housing 32 above mounting flange 34 is formed as a cylindrical surface 110 having circumferential grooves for receiving o-rings 112, 114. A somewhat larger groove 116 extends circumferentially around cylindrical section 110. A vapor conducting hood 118 is formed at one end with a bore 120 which can be rotatively received upon cylindrical housing section 110 in rotatably, sealed relationship, seal being provided by o-rings 112, 114: A plurality of balls 122 are urged into the circumferential groove 116 in the housing by a plurality of set screws such as 124 to axially retain the hood 118 upon housing 32 while accommodating rotative adjustment of hood 118 relative to the housing.

It is believed apparent that upon removal of hood 118 from housing 32, the mounting screws 94 and 96 holding motor 72 in its assembled position within the housing are readily accessible from the exterior of tank TT. In the event of the failure of the o-ring seal between piston 78 and the wall of the piston chamber 76, the entire motor 72 may be removed from the housing as a unit simply by removing screws 94 and 96 and lifting the motor from its seat within the valve housing. By making the motor 72 from molded plastic components, the motor may be manufactured at a cost low enough so that the motor is disposable and is replaced with another motor rather than being repaired.

While one embodiment of the invention has been described in detail, it will be apparent to those skilled in the art that the disclosure embodiment may be modified. Therefore, the foregoing description is to be considered exemplary rather than limiting, and the true scope of the invention is that defined in the following claims.

We claim:

1. A vent valve for venting vapor from the headspace of a liquid containing storage tank, said valve comprising a valve housing having a central axis and adapted to be sealingly mounted at the top of said tank with a passage extending axially through said housing opening at one end into the interior of said tank and opening at its opposite end at the exterior of said tank, means on said valve housing at said one end of said passage defining an annular valve seat extending around the periphery of said passage, a valve head mounted on said valve housing for movement between a closed position engaged with said valve seat wherein said valve head sealingly closes said one end of said passage and an open position wherein said valve head is spaced axially from said seat to place said passage in fluid communication with the interior of said tank, spring means engaged between said valve housing and said valve head resiliently biasing said valve head toward said closed position, a fluid pressure actuated motor including a motor housing having a rod end, a head end and an internal piston chamber, a piston slidably received in said chamber and having a piston rod projecting from said rod end of said motor housing, mounting means for detachably mounting said motor within said valve housing between the opposite ends of said passage with said piston rod extending coaxially of said passage from said motor housing into engagement with said valve head, said mounting means and said motor housing having cooperating passage means therein for selectively conducting fluid under pressure into said chamber to cause said piston rod to push said valve head from said closed position to said open position against the action of said spring means and for selectively venting said chamber to enable said spring means to bias said valve head to said closed position.

2. A vent valve for venting vapor from the headspace of a liquid containing storage tank, said valve comprising a valve housing having a central axis and adapted to be sealingly mounted at the top of said tank with a passage extending axially through said housing opening at one end into the interior of said tank and opening at its opposite end at the exterior of said tank, means on said valve housing at said one end of said passage defining an annular valve seat extending around the periphery of said passage, a valve head mounted on said valve housing for movement between a closed position engaged with said valve seat wherein said valve head sealingly closes said one end of said passage and an open position wherein said valve head is spaced axially from said seat to place said passage in fluid communication with the interior of said tank, spring means engaged between said valve housing and said valve head resiliently biasing said valve head toward said closed position, a fluid pressure actuated motor including a motor housing having a rod end, a head end and an internal piston chamber, a piston slidably received in said chamber and having a piston rod projecting from said rod end of said motor housing, mounting means for detachably mounting said motor within said valve housing between the opposite ends of said passage with said piston rod extending coaxially of said passage from said motor housing into engagement with said valve head, said mounting means and said motor housing having cooperating passage means therein for selectively conducting fluid under pressure into said chamber to cause said piston rod to push said valve head from said closed position to said open position against the action of said spring means and for selectively venting said chamber to enable said spring means to bias said valve head to said closed position, wherein said central axis is a vertical axis, said mounting means including web means integral with said housing projecting radially into said passage above said valve seat and having a motor housing receiving recess extending downwardly into said web means coaxially of said passage, and retaining means for detachably retaining said motor housing in a fixed position within said housing receiving recess.

3. The invention defined in claim 2 wherein said motor housing is of a frusto conical configuration with its side surface converging toward said rod end, said housing receiving recess in said web means having a downwardly convergent complementary frusto conical surface engageable with the side surface of said motor housing to locate said motor housing radially and axially of said valve in a seated position in said recess, said cooperative housing passage means comprising means defining a first bore extending radially from the exterior of said motor housing into said chamber adjacent the head end of said motor housing, and means defining a second bore extending from the exterior of said valve housing through said web means into said recess to open into said first bore when said motor housing is in said seated position.

4. The invention defined in claim 3 wherein said retaining means comprises a projection projecting radially outwardly from said motor housing at its head end into overlying relationship with said web means, and fastener means for detachably securing said projection to said web means.

5. The invention defined in claim 2 wherein said valve head, when in its closed position is spaced below said web means, said piston rod projecting downwardly from said motor housing to rest upon said valve head.

6. A vent valve for venting fuel vapor with respect to the headspace of a fuel storage tank, said valve comprising a valve housing adapted to be sealingly mounted within an opening through the top of said tank with the upper end of said valve housing located at the exterior of said tank and the lower end of said valve housing located in the interior of said tank, means defining a central flow passage through said valve housing extending along a vertical axis from the upper end of said valve housing to its lower end, a valve head mounted on said valve housing for vertical movement adjacent the lower end of said valve housing between an elevated closed position sealing said passage at the lower end of said housing and an open position placing said passage in fluid communication with the interior of said tank, spring means engaged between said valve housing and said valve head biasing said valve head toward said valve seat to normally maintain said valve head in said closed position, fluid pressure actuated motor means including a cylinder having a piston chamber therein and a piston reciprocable within said chamber and having a piston rod projecting from the rod end of said cylinder, mounting means for detachably mounting said motor means in said passage with said cylinder disposed coaxially of said passage and said piston rod projecting downwardly from the rod end of said cylinder to rest upon the top of said valve head, said valve head when in said closed position supporting said piston at an elevated position within said chamber, and passage means extending from a first port adjacent the upper end of said housing through said housing to a second port in said cylinder opening into said chamber at a location above said piston when said piston is in said elevated position for supplying fluid under pressure to said chamber to drive said piston downwardly to cause said piston rod to push said valve head to said open position against the biasing action of said spring means.

7. The invention defined in claim 6 wherein said spring means comprises a plurality of like guide rods fixedly secured at their lower ends to said valve head and projecting upwardly from said valve head to be slidably received in respective vertical guide passages in said housing symmetrically disposed about said vertical axis, and a plurality of like springs respectively biasing said guide rods upwardly relative to said housing.

8. The invention defined in claim 6 wherein said mounting means comprises at least two vertical webs integral with said housing and projecting radially into said passage from locations spaced symmetrically about said vertical axis, means on said webs cooperatively defining an upwardly opening cylinder receiving seat adapted to receive said cylinder of said motor and to locate said motor in radially and axially of said passage in an operative position wherein said piston rod projects freely downwardly below said webs, and fastener means for detachably securing said cylinder to said webs to maintain said motor in said operative position.

9. The invention defined in claim 8 wherein the exterior of said motor cylinder is of a downwardly convergent frusto conical configuration and said webs have downwardly and inwardly inclined radially inner edges complementary to said frusto conical configuration of said cylinder and cooperatively defining said cylinder receiving seat.

10. The invention defined in claim 9 wherein said passage means includes a first passage section extending from said first port through one of said webs to an opening in the radially inner edge of said one of said webs, said opening being aligned with said second port when said motor is in said operative position.

11. The invention defined in claim 10 wherein said fastener means comprises a plurality of mounting tabs projecting outwardly from said cylinder into overlying relationship with the respective webs, and screw means for clamping said tabs downwardly against said webs.

12. The invention defined in claim 11 wherein said screw means includes means defining a tapped bore extending vertically downwardly into each of said webs for threadably receiving a screw passing through a bore in a tab, one of said tapped bores being located at a greater distance from said vertical axis than at least one other bore.

13. The invention defined in claim 8 wherein said housing comprises an integral radially outwardly projecting mounting flange spaced below the top of said housing an extension having a cylindrical outer surface of said housing projecting upwardly from said flange to the top of said housing, a fluid coupling hood having a bore in its lower end adapted to sealingly and rotatively receive said projection, and means for detachably retaining said hood on said projection while accommodating rotation of said hood relative to said projection in sealed relationship therewith.

14. The invention defined in claim 13 wherein said first port is located on the outer periphery of said flange.

* * * * *